US005476084A

United States Patent [19]

Morganti et al.

[11] Patent Number: 5,476,084

[45] Date of Patent: Dec. 19, 1995

[54] ENERGY-ON-DEMAND IGNITION COIL

[75] Inventors: Carl R. Morganti, Farmington Hills; Gitanjli Singh, Canton; Benjamin D. Sweet, Southfield, all of Mich.

[73] Assignee: Ford Motor Company, Dearborn, Mich.

[21] Appl. No.: 283,977

[22] Filed: Aug. 1, 1994

Related U.S. Application Data

[63] Continuation-in-part of Ser. No. 4,008, Jan. 15, 1993, Pat. No. 5,333,593.

[51] Int. Cl.[6] ..... F02P 5/15

[52] U.S. Cl. ..... 123/637; 123/643

[58] Field of Search ..... 123/637, 643

[56] References Cited

U.S. PATENT DOCUMENTS

| | | | |
|---|---|---|---|
| 3,209,295 | 9/1965 | Baermann | 336/155 |
| 3,945,362 | 3/1976 | Neuman et al. | 123/637 X |
| 4,091,787 | 5/1978 | Frank | 123/606 |
| 4,112,890 | 9/1978 | Manger et al. | 123/606 |
| 4,183,340 | 1/1980 | Gilbert | 123/609 |
| 4,546,753 | 10/1985 | Pierret | 123/634 |
| 4,653,459 | 3/1987 | Herden | 123/637 |
| 4,846,129 | 7/1989 | Noble | 123/425 |
| 4,990,881 | 2/1991 | Ooyabu | 336/110 |
| 5,014,676 | 5/1991 | Boyer | 123/637 |
| 5,101,803 | 4/1992 | Nakamura et al. | 123/634 |
| 5,111,790 | 5/1992 | Grandy | 123/425 |
| 5,170,760 | 12/1992 | Yamada et al. | 123/430 |
| 5,333,539 | 8/1994 | Morganti et al. | 123/637 |

FOREIGN PATENT DOCUMENTS 0137939 6/1986 European Pat. Off. .

OTHER PUBLICATIONS

Research Disclosure, No. 329104, anonymous, Sep. 1991.

"The Effect Of Ignition System Power On Fast Burn Engine Combustion", by Richard W. Anderson, SAE Technical Paper #870549, Feb., 1987.

"Programmable Energy Ignition System for Engine Optimization", by Richard W. Johnston et al., SAE Transactions, Technical Paper #750348, vol. 84, Sec. 2, 1975, pp. 847–855.

"Multiple–spark ignition", by Brian Taylor, 1988, pp. 434–435.

*Primary Examiner*—Tony M. Argenbright

*Attorney, Agent, or Firm*—Kevin G. Mierzwa; Roger L. May

[57] ABSTRACT

An energy-on-demand vehicular ignition system with a programmable re-striking and minimum single-strike energy output whereby at idle engine speed and lowest load, each coil will be re-struck or discharged the maximum number of times permitted by the coil design within a limited time interval representing the beginning of the combustion event and occurring within 0–2% MFB of the ignitable air fuel mixture within the combustion chamber. The system strategy also includes programmable re-striking whereby the system will default to a single-strike at conditions above a predetermined range of operating conditions, in particular, at a particular engine speed condition and a particular engine partial load condition. In between the conditions at (i) idle engine speed and lowest load on the one hand and, (ii) a predetermined engine speed and partial load condition. The ignition strategy includes the coil being re-struck more than once, with the particular number of re-strikes being determined in accordance with a preset schedule as predetermined to be ideal for complete combustion at the operating conditions being sensed.

3 Claims, 5 Drawing Sheets

CCP: 0.725 ms Re-Stk 11372 - 11655
CCP: 0.288 ms Re-Stk 11377 - 11649
4-T: 6.5A, Single Stk. 11312 - 11332
4-T: 5.5A, Single Stk. 11342 - 11362
4-T: 6.5A, Re-Stk. 11317 - 11337
4-T: 5.5A, Re-Stk. 11347 - 11367

CCP: 0.725 ms Re-Stk 11214 - 11630
CCP: 0.288 ms Re-Stk 11229 - 11625
4-T: 6.5A, Single Stk. 11247 - 11435
4-T: 5.5A, Single Stk. 11277 - 11412
4-T: 6.5A, Re-Stk. 11297 - 11440
4-T: 5.5A, Re-Stk. 11282 - 11417

ENERGY-ON-DEMAND IGNITION COIL

CROSS-REFERENCE TO RELATED APPLICATION

This application is a continuation-in-part of Ser. No. 004,008 filed Jan. 15, 1993, now U.S. Pat. No. 5,333,593, issued Aug. 2, 1994, and assigned to the assignee of the present application.

TECHNICAL FIELD

This invention relates to ignition coils, particularly for internal combustion engines, and vehicular ignition systems.

BACKGROUND ART

With the advent of the microprocessor and related sophisticated electronic controls, vehicular ignition systems and ignition system strategies have undergone a great many improvements. Among these, more efficient burning of combustion gases, better control of vehicle timing and ignition timing have all played an important part in improving fuel economy, extending the percentage of exhaust gas recirculation, increasing power and improving other performance characteristics.

Changes in the ignition coil design have also been a part of this overall improvement. Use of the single ignition coil for each ignition device, i.e. spark plug, has provided the opportunity to more precisely control ignition characteristics within each combustion chamber. However, almost without exception, these strategies evolve around a single ignition per combustion event. Beyond the timing of the ignition event, combustion efficiency has depended in large part on the combustion chamber design, including measures for increasing combustion gas swirl prior to ignition, and similar techniques.

In addition, limited use has been made in an ignition strategy involving "re-striking" the ignition generator during the same ignition event. In other words, the spark plug has been caused to fire multiple times during each combustion cycle, and provided the engine is operating below a predetermined speed, e.g. 1200 RPM. At engine speeds above the predetermined level, the ignition coil and thus the ignition device itself would fire but once per conventional practice.

One known system using a re-strike strategy includes use of an electronic distributorless ignition system (EDIS) having two coils adapted to distribute ignition voltage to each of four combustion chambers, and known as a four-tower-type coil pack. Such a coil pack is fairly large, having to (i) provide ignition to each of the two cylinders for each combustion event of the engine and (ii) accommodate for performance losses across the spark plug leads. Re-strike rapidity or the timing capability of a coil has been noted to be directly proportional to coil size, that is the size, weight and number of turns or windings to the primary and secondary coils. Consequently, with the four-tower EDIS system previously known, the re-strike strategy did not incorporate all re-strikes within the initial stages of the combustion event, nor was the significance of such a strategy realized until the present invention.

SUMMARY OF THE INVENTION

The subject invention provides an ignition strategy with a programmable re-striking and minimum single-strike energy output whereby at idle engine speed and light load, each coil will be re-struck or discharged the maximum number of times permitted by the coil design within a limited time interval representing the beginning of the combustion event and occurring within 0–2% of the mass fraction burn ("MFB") of the ignitable air fuel mixture within the combustion chamber.

The present invention also contemplates a CPP system with programmable re-striking whereby the system will default to a single-strike at conditions above a predetermined range of operating conditions, in particular, at a particular engine speed condition and a particular engine partial load condition.

In between the above-mentioned conditions, the present invention contemplates an ignition strategy whereby the coil will be re-struck a variable number of times below or less than the maximum number of re-strikes permitted by the coil design with the particular number of re-strikes being determined in accordance with a preset schedule as predetermined to be ideal for complete combustion at the operating conditions being sensed.

The present invention also contemplates a re-strike coil-type ignition system for electronic distributorless ignition of any internal combustion engine wherein (i) the number of times the coil is charged and re-struck is dynamically controlled by certain predetermined engine operation conditions being continually sensed during operation and (ii) all re-strikes are delivered within a predetermined time representing 0–2% MFB per each combustion event, and preferably representing within 0.5% MFB.

The above objects and other objects, features, and advantages of the present invention are readily apparent from the following detailed description of the best mode for carrying out the invention when taken in connection with the accompanying drawings.

BEST MODE FOR CARRYING OUT THE INVENTION

Figure 1:
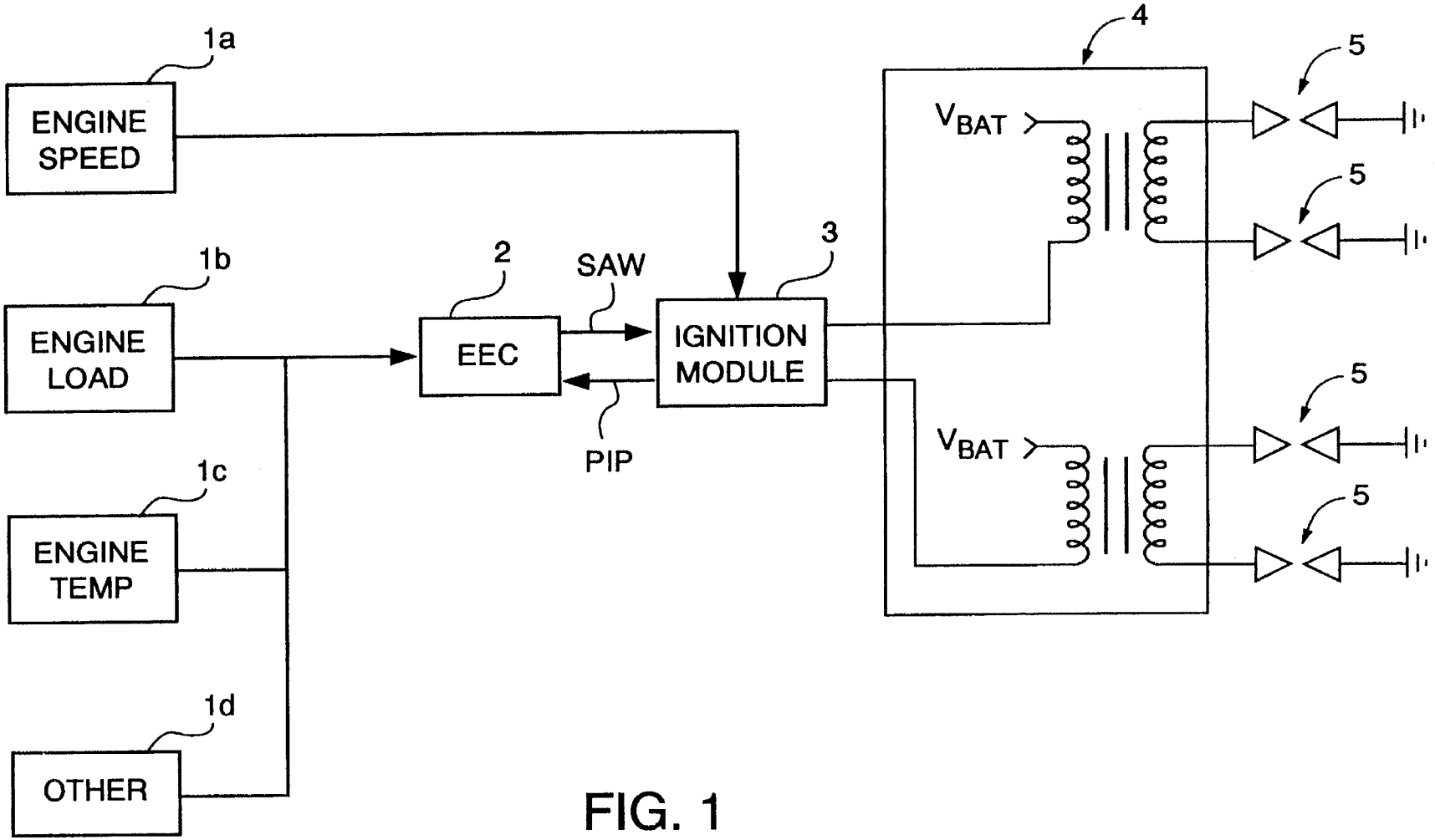
FIG. 1 shows a schematic diagram of the four-tower coil pack ignition control system in accordance with the present invention.

The optimum vehicular ignition system for a multi-cylinder, reciprocating internal combustion engine, commonly in use today, will address the following concerns:

- improve combustion quality, particularly at conditions of idle, light partial load and deceleration and over a large range of presented EGR levels;
- system packageability;
- system weight;
- fouled plug firing;
- extended spark plug electrode life;
- reduced radio frequency interference;
- system reliability; and
- system cost.

Early on in the development of the present invention, it was realized that the ignition energy, i.e. the ignition coil output, requirements for a particular combustion event varied greatly, depending on the engine operating conditions, and in particular engine speed, engine load, percentage exhaust gas recirculation, variations in spark advance over time, and in the case of variable spark advance, the spark advance range to be accommodated in the system, air fuel ratio, brake mean effective pressure (BMEP), and, in particular a useful operating range of BMEP. It was determined this energy requirement may vary in the order of an 8:1 ratio, with the greatest energy being required at conditions of low engine speed and low load, notorious for conditions of incomplete combustion and resultant spark plug fouling. The least amount of energy is required at the high speed minimum load condition. Thus, if one designs an ignition coil capable of supplying the needed energy at low speed/low load conditions, maximum spark advance, highest percentage EGR, etc., the cost and weight of the coil is increased over that which is required at the high speed operating end of the engine. Furthermore, the higher energy output more quickly erodes the spark ignition device, thus decreasing spark plug electrode life.

It was also realized that there is only a very specific portion of the combustion event during which this increased ignition energy is useful in promoting complete combustion, that being during the very initial stages of combustion flame propagation across the combustion chamber.

It was further determined that if one were to design the ignition coil on the basis of the minimum energy required throughout the operating conditions of the engine, i.e. higher speed, lighter load, the downsizing of the ignition coil would permit or produce a coil capable of being re-struck a plurality of times during the aforesaid initial stages of a combustion event. In other words, because of the downsizing of the components, a decrease in dwell time between discharges is provided so that through multiple discharges a significant increase in cumulative ignition energy can be delivered over a very short, useful period of time.

The effects of this ignition strategy were complemented all the more with a coil per plug ignition control system which permits downsizing the ignition energy requirements to their lowest value, thereby permitting the minimum weight, cost and packaging, all as described in detail in related U.S. Pat. No. 5,333,593. However, similar benefits were seen to be available for multiple coil packs such as the two-tower and four-tower coil packs referred to therein.

In establishing the particular design parameters for an energy-on-demand ignition system, combustion data for the engine is developed thereby establishing not only the maximum and minimum energy requirements, but also the particular number of re-strikes required at each operating condition or combination of operating conditions programmed into the control system. In each case, the overall ignition control system will be the same. For example, as seen in FIG. 1, the ignition control system in accordance with the present invention for the four-tower coil pack will include a number of engine operating condition sensors 1*a*–1*d*. The two sensors, 1*a* and 1*b*, are set up to sense, respectively, engine speed and engine load (as represented by manifold pressure) which are the most important to the present invention. The remaining sensors and others may be optional for the present invention of controlling re-strike strategy for sensing any number of other operating conditions to be programmed into the system. For example, one may wish to sense engine temperature, air/fuel ratio or spark advance in a variable spark advance system, all of which can influence, in a comparatively minor way, the re-strike strategy based on the sensing of engine speed and load. The output of these sensors is fed to a combination electronic engine controller (EEC) and central processing unit (CPU). Based on the design parameters programmed into the EEC unit 2, a digital control signal is sent to an ignition module 3. This signal, spark angle word (SAW), dictates to the ignition module at what position in the combustion cycle the spark should occur. The ignition module, in turn, uses this information from SAW and its own sensor input of engine speed and crankshaft positions to calculate when and which primary circuit to close for the ignition coil pack 4 to charge, in order that the predetermined maximum primary current desired occurs at the desired time within the desired cylinder's compression stroke. When this maximum primary current is reached, the ignition module opens the primary circuit, forcing the coil to fire the spark plug. In addition, the EEC control signal registers to the module the desired number of strikes, whether it is one or more. Using this information, the ignition module controls the rate of re-striking, i.e. the duration of firing and the duration of dwell, or recharging. The ignition module further communicates with the EEC by relaying confirmation that a satisfactory spark occurred through the ignition or engine diagnostics monitor (IDM or EDM). The four-tower ignition coil pack 4, in this preferred embodiment, includes two double-ended coils, with each coil firing two sparkplugs 5, each residing in a different cylinder.

Figure 2A:
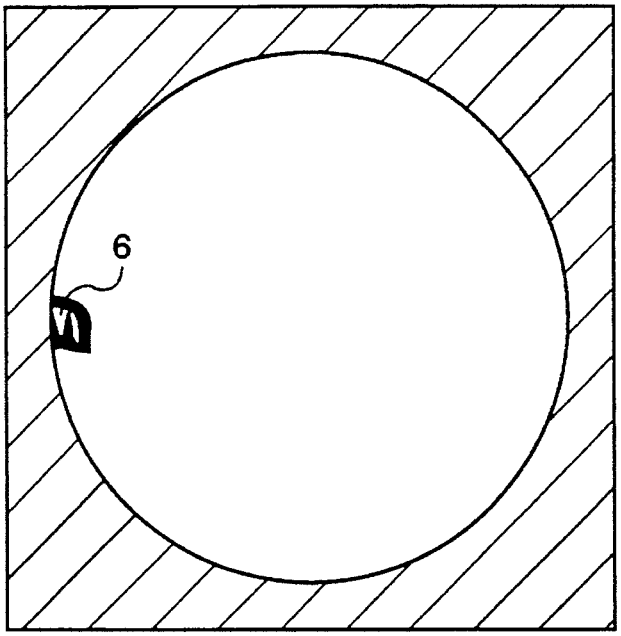
FIG. 2*a* is a pictorial representation of a combustion event occurring within a particular combustion chamber at 0.3 milliseconds ("msec") following first ignition (representing the initial flame kernel and less than 2% MFB)
Figure 2B:
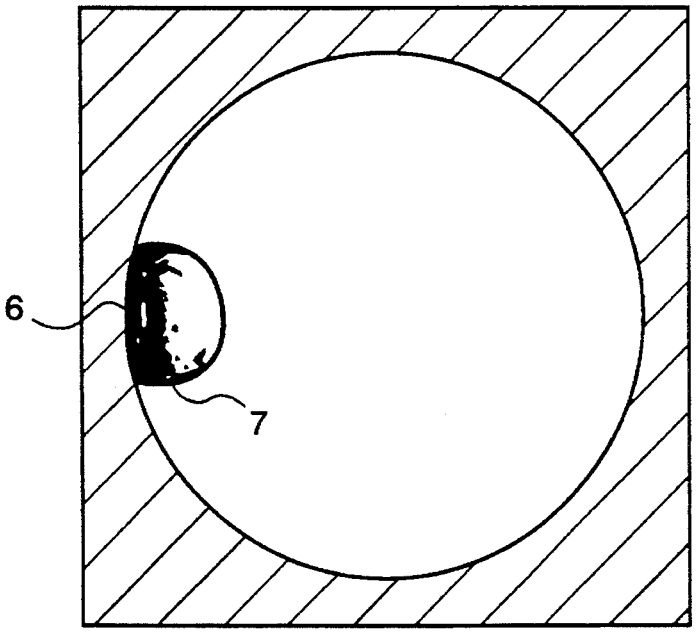
FIG. 2*b* is a pictorial representation similar to FIG. 2*a* and showing propagation of the flame front within the combustion chamber after a period of about 4.6 msec from the initial spark generation and ignition and representing approximately 5–10% MFB.
Figure 3:
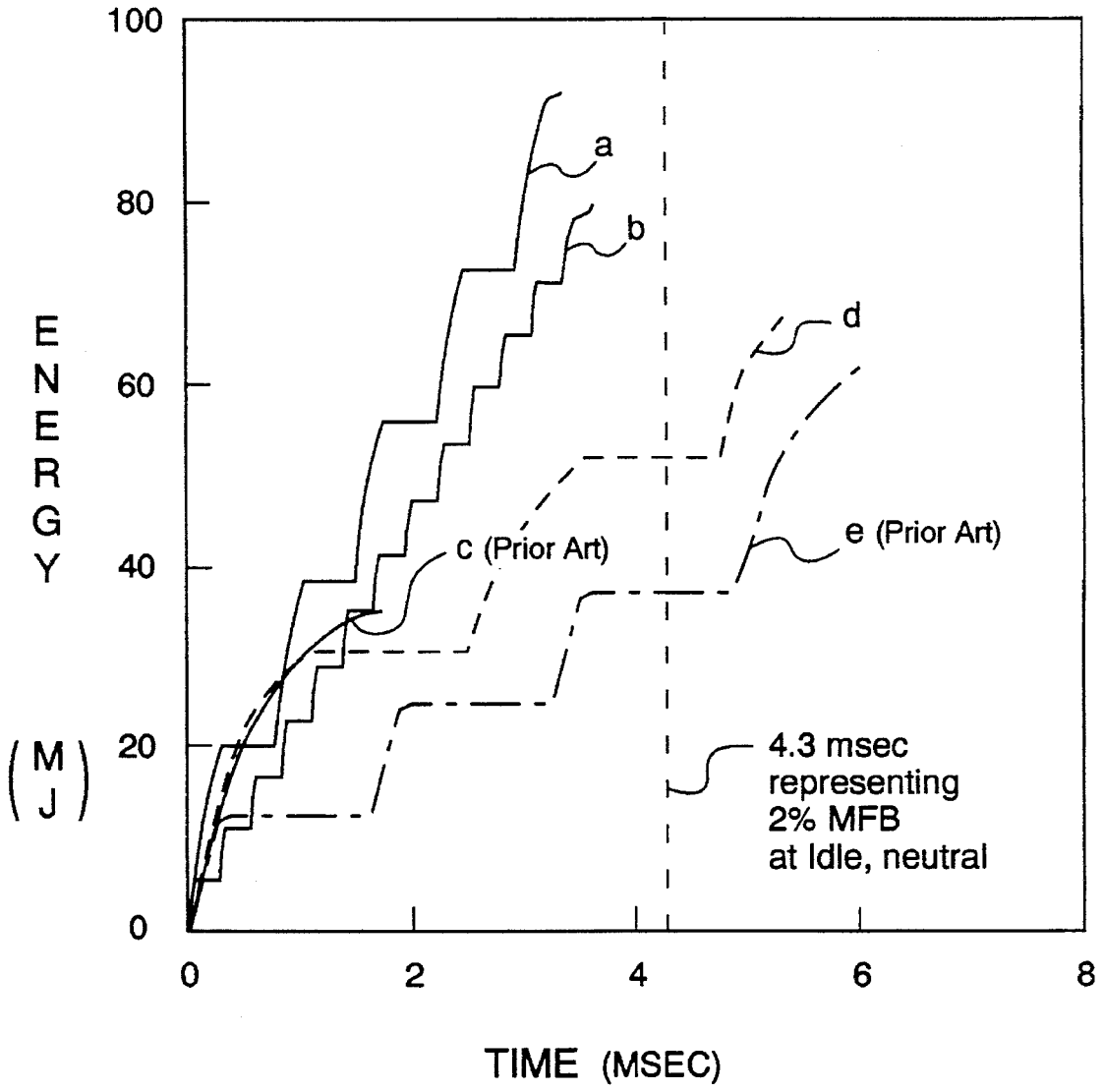
FIG. 3 is a graphical comparative presentation of accumulated spark energy over time utilizing a coil-per-plug ("CPP") ignition system strategy and a four-tower coil pack ignition system with multiple re-strikes within a time period representing 0–2% MFB in accordance with the present invention as compared to a conventional single-strike four-tower ignition system strategy and known four-tower coil pack ignition strategy referred to earlier.

In terms of developing the design criteria for the re-strike ignition strategy, the burn characteristics of the fuel-air charge within the combustion chamber is taken into consideration. For example, in FIG. 2*a* there is shown the flame kernel development around a spark gap at after initiation of the spark discharge. The degree of flame kernel development shown is typically associated with 0.5% MFB. From FIG. 2*b*, it will be noted that as the flame front is propagating away from the spark gap, it leaves only a burned mixture in the vicinity of the spark gap. The spark gap is noted at 6 and the burned mixture is the gray area generally designated 7. From this instant on, which as shown represents 4.3 msec after initiation of the spark discharge, the spark gap 6 is surrounded by burned mixture 7, and hence no substantial additional benefit to the combustion process can accrue at this or any later instant in time. As shown in FIG. 2*b*, the percentage MFB is considerably beyond 2% MFB and in the order of approximately 5–10%. Although flame speed and the effectiveness of re-striking or additional ignition energy may vary dependent upon numerous factors, e.g. combustion ratio, fuel octane, air fuel ratio, combustion chamber geometry, and the like, it is believed that the criteria of re-striking within a time period following initiation of spark discharge of no more than about 2% MFB as represented in FIG. 3 as 4.3 msec at an engine speed of 800 rpm, i.e. idle, will be quite satisfactory for the general range of automotive engines in use today. Obviously, as engine speed increases, the mass fraction burn time will be decreased, i.e. in the example given, 2% MFB at 2500 rpm will be in the order of 1.5 msec.

FIG. 3 is a representative comparative chart showing accumulated spark energy over time for the coil per plug ignition strategy with programmed re-strikes in accordance with the present invention, as compared with a conventional single-strike ignition strategy. Plot a shows a coil per plug ignition strategy with the coil having a 0.725 msec re-strike interval, i.e. the time between successive strikes or discharges of the coil. The coil has a single strike rating of 20 milliJoules ("mJ"). Plot b shows the same coil per plug width programmable re-strike ignition strategy within the re-strike interval being set at 0.288 msec. Each plateau in the stepped energy curve represents a re-strike. Thus, in plot a, the first strike delivered 20 mJ energy (the minimum required to ignite a typical vehicular air/fuel combustible gasoline mixture). Five strikes in all were delivered in a time of about 3.5 msec and with a total energy input of about 95 mJ. Plot c shows a single-strike ignition strategy developed using a production model EDIS system provided with 6.5 amperes current for the primary circuit, and delivering approximately 30–35 mJ energy to the combustion event.

There is shown in plot d the same EDIS four-tower 6.5 amp system provided with a multiple re-strike ignition strategy at 6–5 amps and utilizing high tension lead lengths. It will be noted that with the CPP system shown in either of plots a or b, approximately 2.5 times the spark energy is supplied for a particular combustion event within an ignition or burn time of 3–4 msec. Thus, with the present invention, looking at plot a, one notes that if a 20 mJ energy output is the minimum energy required to maintain combustion at high speed and light load, one can expect a five-fold increase in ignition energy during those operating conditions, e.g. idle, requiring maximum spark energy.

One also notes from plot d the advantage to providing the same programmable re-strike program for ignition systems other than the CPP system such as the aforementioned four-tower EDIS system or a two-tower EDIS system, wherein a single twin-tower coil provides spark energy to two separate combustion chambers or ignition devices. All the aforementioned coil system (CPP, two-tower, four-tower) may be of modular design such that, for example, three or four twin-tower coils can be electronically coupled in a coil pack to thereby provide an ignition system for any six-cylinder or eight-cylinder engine, respectively. As shown, the strategy at engine idle is to strike two or three times within the 2% MFB time, providing approximately 30 mJ energy with the first strike and 48 mJ with the first restrike. The second restrike usefulness will depend on operating conditions. Nevertheless, the maximum/minimum energy levels are at a ratio of at least 6:1. The minimum energy level is the energy of the initial strike (capable of providing ignition for a conventional single strike system), i.e. the minimum energy level deliverable by the coil element during the initial stage of the combustion event (30 mJ in the example given) whereas the maximum energy level is the energy established over the entire restrike program ($48^+$ mJ in the example given).

This is compared to the conventional four-tower coil pack system shown in plot (e) wherein multiple restrikes were incorporated into the ignition strategy but not delivered within the burn time soon enough to be of any value.

Figure 4:
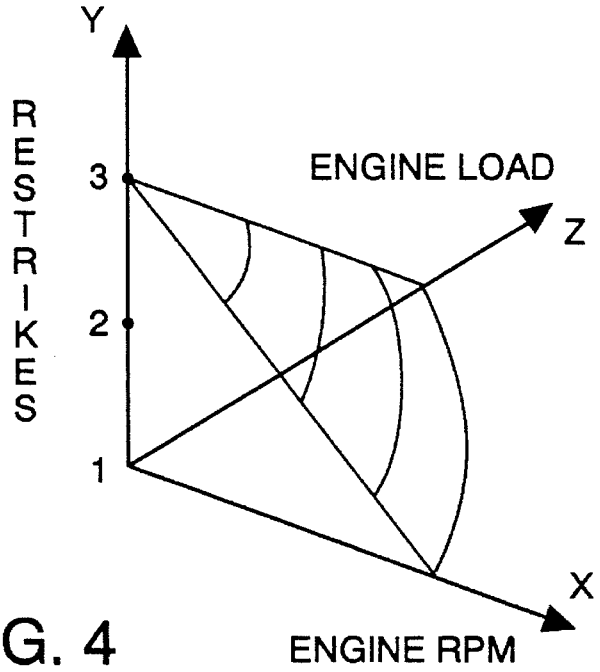
FIG. 4 is a three-dimensional graphical presentation of the predetermined programmable re-strike requirements for the four-tower coil pack ignition system in accordance with the present invention over a range of engine speeds and loads.
Figure 5:
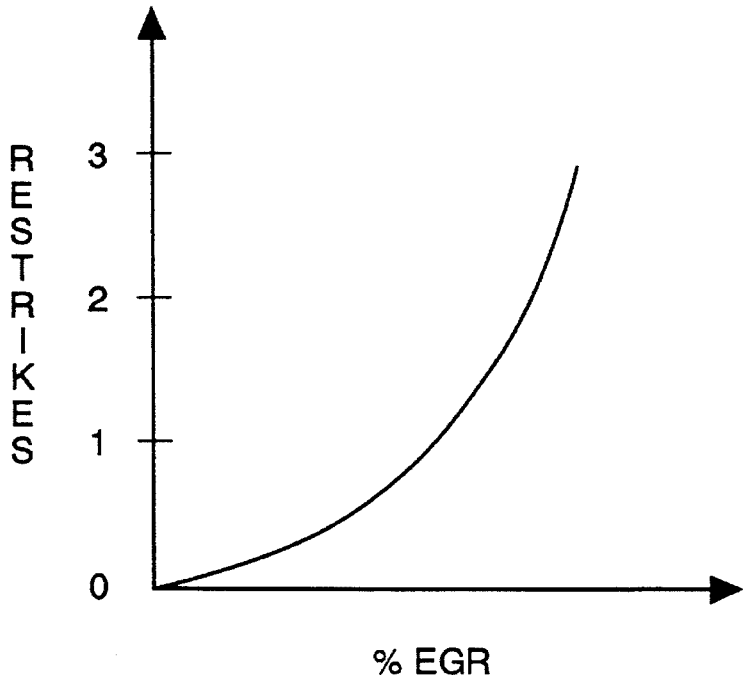
FIG. 5 is a graph showing the manner in which an engine's ability to completely combust larger increased percentages of exhaust gas recirculation ("EGR") is improved within an ignition system as the useful ignition energy as represented by the ignition coil re-strikes is increased.

FIG. 4 shows a typical three-dimensional isobar or isometric-type chart which can be developed for any engine. The chart shown is illustrative only and is not meant to depict any particular engine or set of operating conditions. It is based on a MALLARD minimum ignition energy equation and model, a design tool well known in the art, and to be subsequently confirmed by dynamometer testing of the particular engine, as also known in the art. It will be noted that as engine load and/or engine RPM increases, the number of re-strikes required to achieve complete combustion is decreased and that at some point (as represented by points (a) and (b)) the coil control strategy will default to requiring only a single strike, i.e., no re-strike. Implicit in the operating data represented in FIG. 4, is the fact as shown in FIG. 5 that the ability to obtain complete combustion with an increase in the percentage exhaust gases recirculated (EGR) to the combustion chamber is increased substantially as the spark energy is increased as represented by the number of re-strikes being increased. In an alternative control strategy, rather than rely on the implicit effect of EGR levels or re-strikes, one can provide an additional sensor 1*a*–1*d* as shown in FIG. 1 to measure the EGR level, and supplant the programmable instructions on engine load and speed to assure a predetermined number of restrikes at the sensor indicated EGR level.

Figure 6:
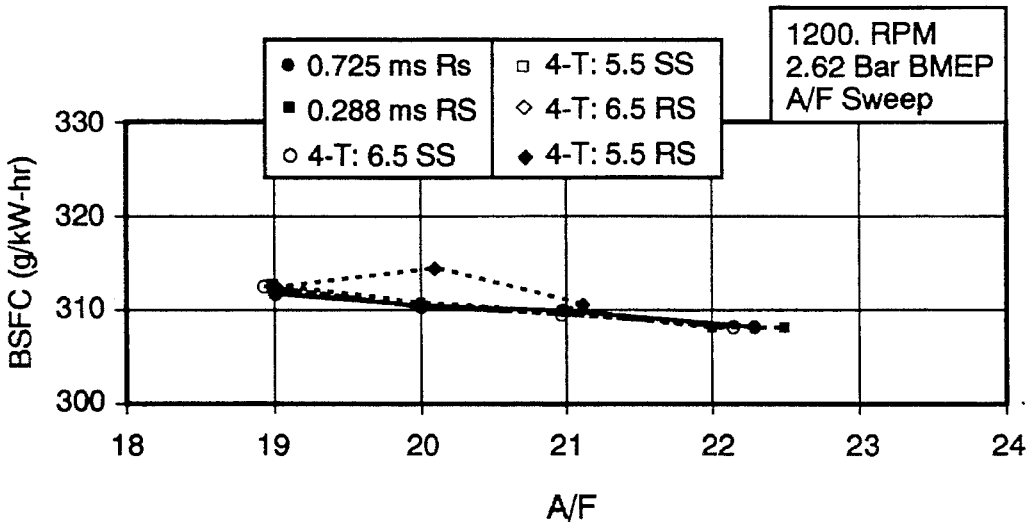
FIGS. 6 and 7 represent the results of various key tests performed on a four-tower coil pack ignition system for a particular engine in accordance with the present invention, and in order to determine optimum operating parameters to be programmed into the ignition system in accordance with the present invention.
Figure 7:
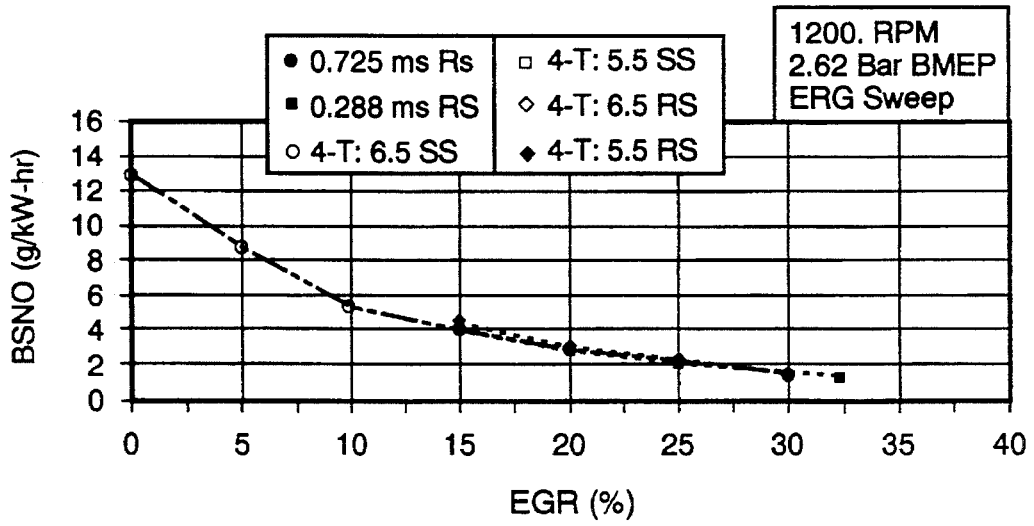

FIGS. 6 and 7 show the results of several tests conducted by bench tests, i.e. dynamometer test techniques, for collecting and using combustion data to develop a re-strike calibration strategy. In each case, a 2.0 liter displacement, four cylinder gasoline engine was used, being the same engine used for developing the data in FIG. 3.

As will be clear to those skilled in the art, by using the above described techniques, one can select an ignition system designed for a single-strike default position producing minimum energy at the default position for operating the engine on a single-strike ignition strategy and engine speeds exceeding any predetermined amount and at engine loads exceeding any predetermined amount. One can also deduce the maximum number of re-strikes to be programmed into the ignition system to deliver the most useful spark energy over the initial stages of the combustion event during which time the spark energy will be useful in promoting faster and more efficient combustion. Likewise, one can map or determine the number of re-strikes to be selected at any particular operating conditions between the maximum re-strike ignition strategy and the default position of a single-strike strategy. FIG. 6 clearly shows the advantage in the re-strike strategy over the single strike strategy. Every coil, be it a coil-per-plug or twin-tower coil, demonstrated the ability to combust the leaner (higher air/fuel ratio) fuel mixtures, thereby enhancing possibilities of fuel economy. FIG. 7, likewise demonstrates the same advantages to the re-strike program in being able to accommodate higher levels of EGR in the combustion, thereby improving emissions.

While the best mode for carrying out the invention has been described in detail, those familiar with the art to which this invention relates will recognize various alternative designs and embodiments for practicing the invention as defined by the following claims.

What is claimed is:

1. In a multicylinder, reciprocating internal combustion engine having a spark ignition generator for each combustion chamber within a respective cylinder, and an ignition coil element electrically coupled With at least one spark ignition generator for repeatedly passing to the ignition generator a voltage sufficient to cause within each said combustion chamber a combustion event of predetermined ignition energy;

control means repetitively charging and discharging said ignition coil element during the initial stage of any combustion event occurring within 0% mass fraction burn to about 2% mass fraction burn within said respective cylinder;

said ignition coil element having a single strike discharge energy output sufficient to cause substantially complete combustion at operating conditions exceeding idle speed and light load conditions;

said ignition coil element having a secondary voltage charge time sufficient to allow said coil to be discharged repeatedly during the initial stage of a single combustion event; and the maximum and minimum energy levels deliverable by said coil element during the initial stage of any combustion event being at a ratio of at least 1.6:1, with said maximum energy level being established over a period of 2–3 discharges.

2. The invention of claim 1 wherein said ignition coil element includes a pair of double-ended coils with each coil electrically coupled to a spark ignition generator at each respective end of the coil.

3. The invention of claim 2 wherein said ignition coil element delivers a minimum single-strike energy of at least about 30 mJ and a maximum energy output within the 2% mass fraction burn of at least about 48 mJ.

* * * * *